United States Patent [19]

Saylor

[11] Patent Number: 4,787,425

[45] Date of Patent: Nov. 29, 1988

[54] PREFEED AND BENDER ASSEMBLY FOR BALE WIRES

[75] Inventor: Millard P. Saylor, Arlington Heights, Ill.

[73] Assignee: Frank L. Wells Company, Kenosha, Wis.

[21] Appl. No.: 124,026

[22] Filed: Nov. 23, 1987

[51] Int. Cl.[4] ..... B21F 15/04

[52] U.S. Cl. ..... 140/73

[58] Field of Search ..... 140/73, 93 R; 100/8, 100/25

[56] References Cited

U.S. PATENT DOCUMENTS 181,631 8/1876 Brock ..... 100/8

*Primary Examiner*—Lowell A. Larson

*Attorney, Agent, or Firm*—Edward D. Gilhooly

[57] ABSTRACT

An assembly to receive, guide and bend a bale wire having a preformed end. The bale wire is bent to facilitate the joining of the preformed ends to be applied to a bale. The assembly includes a plurality of fixtures which receive an preformed end of a plurality of bale wires at predetermined positions. The assembly is then subjected to a rotational movement to bend the wire tie after which the preformed ends can be joined with ease.

19 Claims, 4 Drawing Sheets

PREFEED AND BENDER ASSEMBLY FOR BALE WIRES

BACKGROUND OF THE INVENTION

1. Field of the Invention

This invention relates to wires for retaining bales and, more particularly, to a prefeed and bender assembly for receiving, retaining and bending a preformed end of a bale wire prior to connection with the preformed opposite end of the wire.

2. Description of the Prior Art

It is common practice to wrap a large bundle of material, generally referred to as a bale, for transport and handling by means of a plurality of straps or metal wires. To use metal wire as a securement technique, the ends are formed in particular configurations that may be manually or automatically linked to form a continuous loop around the bale. One preformed wire connection demonstrating strength characteristics of at least 95% of the tensile strength of the wire itself is disclosed in U.S. Pat. No. 4,375,118 issued Mar. 1, 1983 to Millard P. Saylor. The preformed ends described in the Saylor patent may be manually interconnected at the side of the bale in contrast to a well known connection commonly referred to as a square knot connection. The prior art square knot connection not only has poor strength characteristics, but must be disposed at the top of the bale. When using conventional bale presses, it is difficult for the person applying the bale wire to view the connection during attachment.

The Saylor connection of said patent facilitates attachment by being connectable at the side of the bale. Although the Saylor connection is convenient to attach, the stiffness of the bale wire makes it difficult for personnel to feed and handle the wire. Each bale must be wrapped by six or eight wires after compression by a press. It is necessary to bend the stiff wire manually to facilitate the joining of the preformed ends, such as described in the Saylor connection, for interconnecting. Manual bending is fatiquing to the personnel applying bale wires to a large number of bales during a normal work assignment. Such difficulties can interfere with the overall efficiency of application of wires to the bales. Accordingly, it is desirable to provide an assembly by which bale wire may be easily and efficiently applied to bales.

SUMMARY OF THE INVENTION

It is, therefore, an objective of the invention to provide a prefeed and bender assembly to facilitate application of securement wires to bales of material, such as cotton, wool, man-made fibers and the like. The assembly herein disclosed permits a preformed end of the bale wire to be prefed and retained at a fixed position prior to connection with the preformed portion at the opposite end of the wire. The assembly of the invention thereupon automatically bends the wire prior to coupling of the two preformed ends to form a continous loop around the bale.

The assembly of the application may be operatively mounted on conventional bale presses. The bale wire is fed through novel tracks of the invention situated on the bale press platen to guide the wire in a straight line to the assembly disclosed herein. The assembly includes a plurality of fixtures compatible with the Saylor connection, positioned adjacent the exits of the tracks to receive the leading preformed ends of the bale wires. The fixtures function as stops for locking the leading ends at appropriate positions.

Power means rotate the fixtures having the retained wire ends to bend the wire at an angle relative to the bale. The opposite preformed ends can then be looped around the remainder of the bale and the connection can be made. The invention greatly increases the speed and efficiency of applying bale wires. The fatique in bending wire manually as in prior art techniques is eliminated. The wear and tear on the operator's hand, which occurs in manual bending of wire, is alleviated by the assembly of the invention.

DESCRIPTION OF THE PREFERRED EMBODIMENTS

Figure 6:
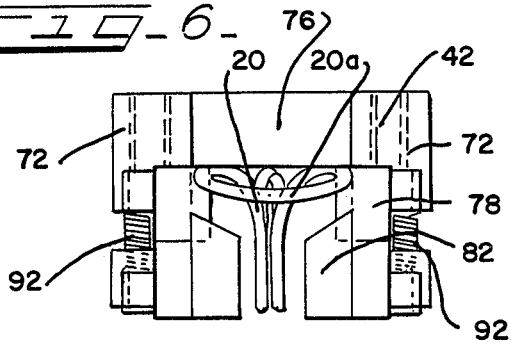
FIG. 6 is a front elevational view of one of the fixtures of FIG. 1.
Figure 7:
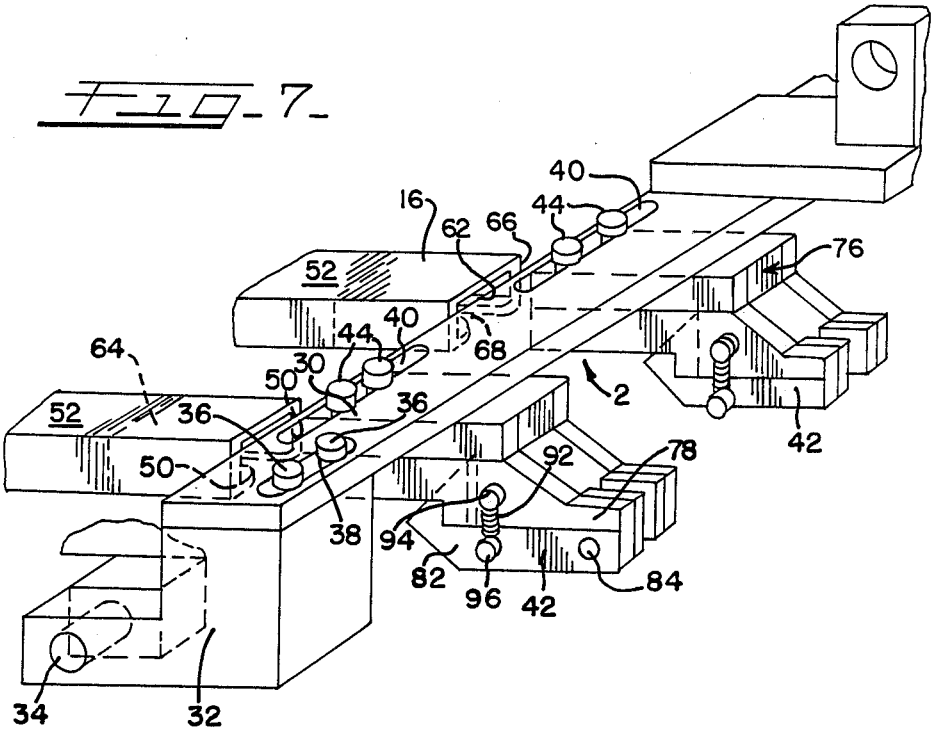
FIG. 7 is a partial front perspective view of the bender assembly of FIG. 1.
Figure 8:
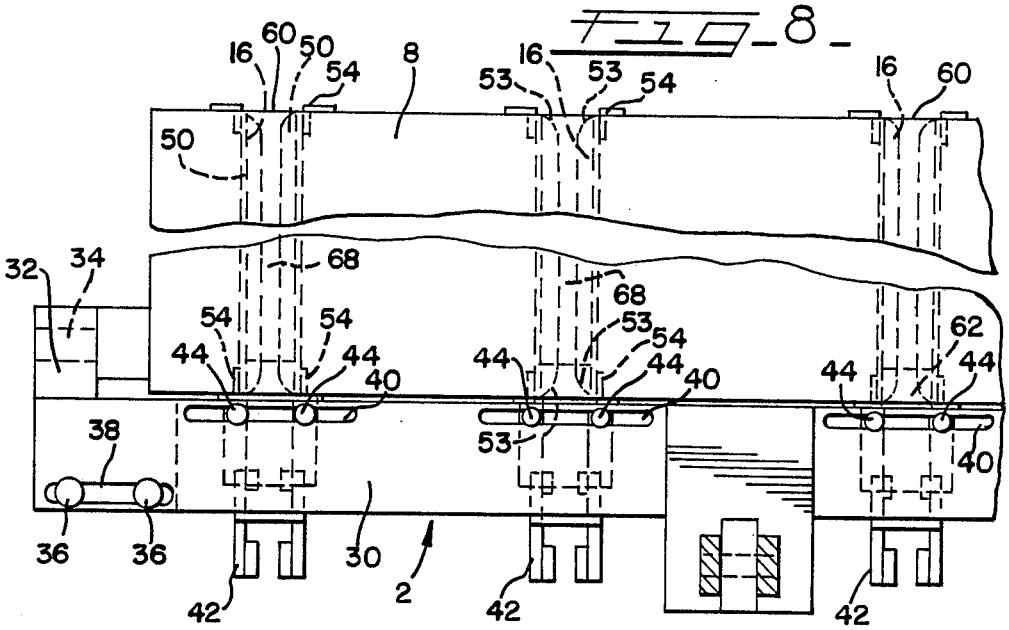
FIG. 8 is a partial top plan view of the bender of assembly of FIG. 1 mounted adjacent the upper platen of a bale press.

Referring now to the drawings, there is illustrated the pre-feed and bender assembly for bale wires of the invention, generally designated by reference numeral 2. The assembly 2 is shown in FIG. 2 mounted adjacent a conventional bale press 4 in which a bale 6 of cotton, wool, man-made fiber or other material is positioned. Although bale presses possess several commercial designs, a typical model, partially illustrated in FIG. 1, includes an upper platen pad 8 and lower upward moveable platen or follower (not shown) to compress the bale 6 therebetween. The upper platen 8 is mounted beneath a conventional upper beam 10 and base plate **10*a* on which the assembly 2 of the invention is mounted. The platen 8 of a typical bale press includes a plurality of separated blocks 12 to form a plurality of channels 14. As seen in FIGS. 7 and 8, novel bale wire tracks 16 of the invention are situated in the channels 14, to receive the leading preformed ends 20 of the bale wires which are manually fed through channels 14 along the tracks 16 from the opposite sides of the bale press as shown. The bottom platen (not shown) beneath the bale also includes channels through which the other preformed ends 22 (FIG. 3) of the bale wires are fed for connection to a respective preformed end 20 as will be apparent. The preformed end 20 may include an end loop 20*a* and a hook 20*b* as shown, for example, in U.S. Pat. No. 4,423,538 and FIGS. 2 to 6**.

As seen in FIGS. 1,2,3,7 and 8 the assembly 2 includes an elongated pivot bar 30 pivotally mounted on the bale press by a pair of brackets 32 at each end having a respective pin 34. The pins 34 are rotatably attached to the upper platen 8 or alternatively to the press beam 10. A pair of threaded members 36 affix the pivot bar through end shots 38 (FIGS. 7 and 8) formed therein to the pivot brackets 32.

As seen in FIG. 2, the pivot brackets 32 normally retain the pivot bar in the horizontal position. The pivot bar 30 is formed with a plurality of aligned elongated slots 40, such as eight slots when a corresponding number of bale wires are being applied to the bale. A plurality of fixtures 42 are respectively affixed to a slot 40 by means of the bolt members 44 extending through the slot 40 into the fixture as seen in FIG. 8. The extended length of slots 40 permits the fixture 42 to be selectively adjusted relative to the bale press to compensate for variations in equipment design and to insure proper alignment of the fixture 42 with the leading end 20 of the bale wire being fed through the upper plated 8.

As best seen in FIGS. 7 and 8, each track 16 includes a pair of elongated L-shaped side members 50 and a top portion 52 that extend along the length of upper platen channels 14. The front and back edges 53 of L-shaped member 50 are rounded for better insertion and exiting of the bale wire through the upper platen 8. In FIG. 8 a pair of L-shaped brackets 54 are affixed to the end portion of each of the L-shaped side members 50 and to blocks 12 by threaded members (not shown) The leading end 20 of the bale wire is inserted into end 60 of each track 50 and is pushed outward from end 62 into a respective fixture 42. A magnet 64 is mounted on track 50 at end 62 to maintain the fed bale wire elevated in alignment with fixture 42 as the leading end 20 transverses the gap 66 (FIG. 2) between the end of track 50 and fixture 42. The bottom of track 50 includes a groove 68 to permit the bale end 20 to be inserted with hook end **20*b*** down.

Figure 3:
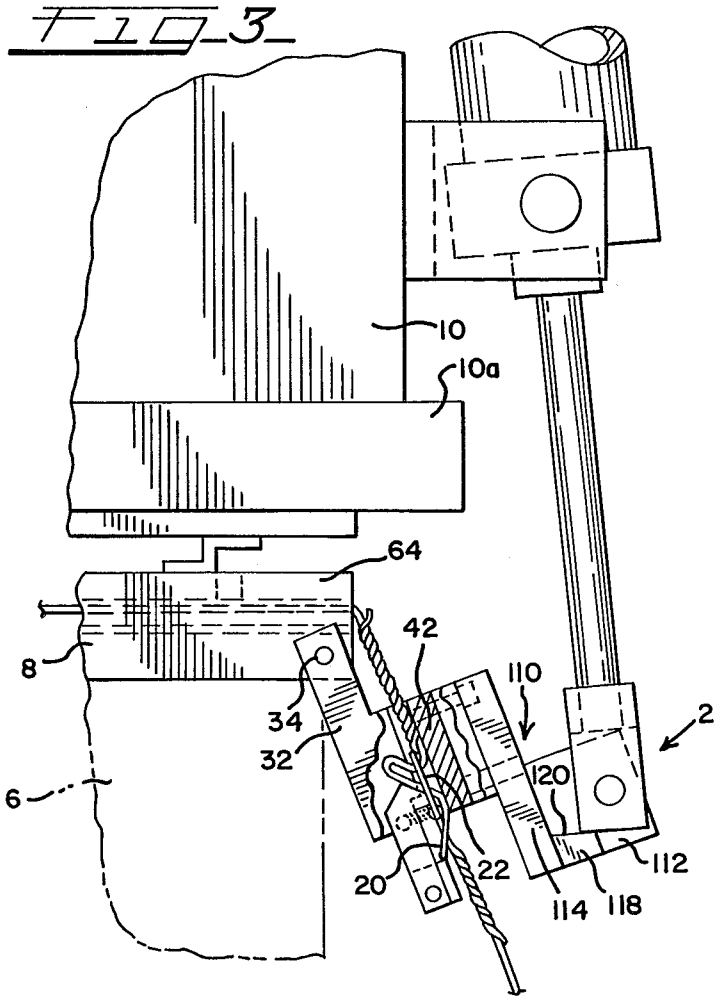
FIG. 3 is a side elevational view of the assembly of FIG. 1 after the fixtures have undergone a rotational movement.
Figure 4:
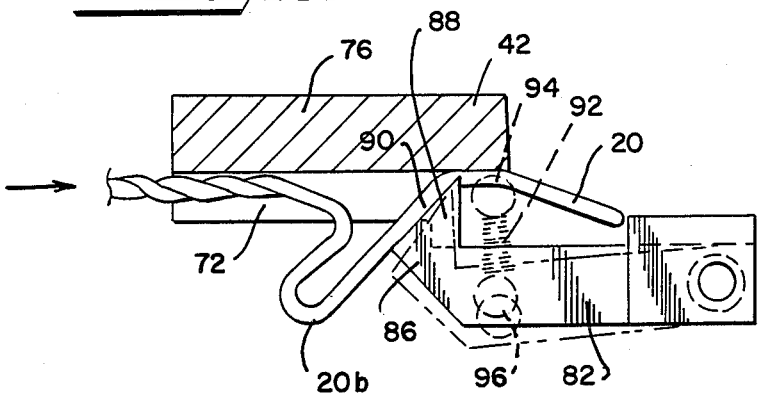
FIG. 4 is a partial side elevational view, with parts in section, of one of the fixtures of the assembly of FIG. 1 taken along line 4—4 of FIG. 5.
Figure 5:
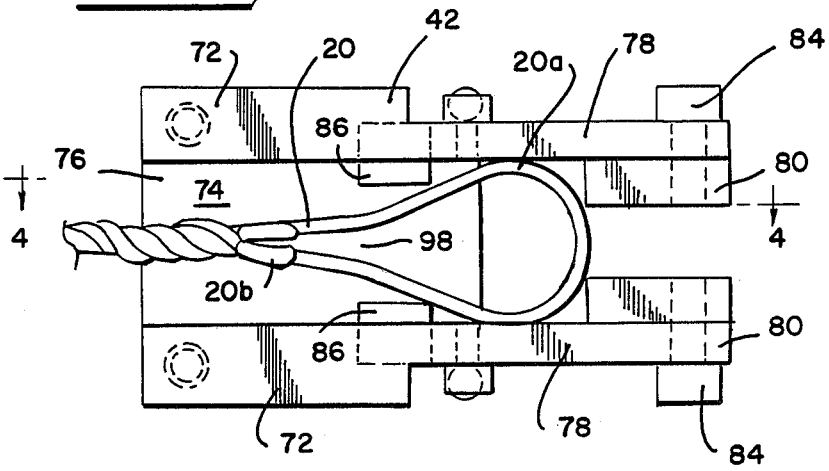
FIG. 5, is a top bottom view of one the fixtures of FIG. 1.

Fixture 42 acts as a retention means to capture the leading end 20 and also as a bender assembly to bend the fed bale wire downward adjacent to face of the bale 6 as seen in FIG. 3. As illustrated in FIGS. 4 to 6, flat upper plate 70 and a pair of downward extending spaced side walls 72 form an open bottomed, entrance portion 74 of the fixture 42 for receiving the leading end 20 of the bale wire. A magnet 76 is mounted in plate 70 and acts to attract the bale wire upward as it is fed to through the fixture 42.

The side walls 72 include projecting portions 78 extending beyond the upper plate 70 and terminate with respective integral blocks 80 against which the leading end 20 ultimately bears after insertion into fixture 42. A pair of pivot arms 82 are pivotally mounted on a respective projecting portion 78 by suitable pivot pins 84. The pivot arms 82 are formed with enlarged tops 86 disposed adjacent the entrance portion.

An upward projecting portion 88 having beveled edge 90 is integrally formed on each of the stops 86. The leading preformed end 20 of the bale wire acts to contact the beveled edges 90 upon insertion and cause the pivot arms 82 to pivot downward to permit passage of the end 20. The pivot arms 82 are resiliently biased to the projecting portion 78 by extension springs 92. In the upper position, the top of pivot arms 82 contact the magnet 76 to maintain them in position. The ends of springs 92 are affixed to pins 94, 96 respectively formed on projecting portion 78 and pivot arms 82. Accordingly, the leading preformed end 20 cams the pivot arms 82 downward and passes to a position to bear against end blocks 80. After the end 20 clears the projecting portion 88, the springs 92 bias the pivot arms 82 back to their original position bearing against magnet 76. Since the space 98 between stops 86 is less than the width of the end portion of preformed end 20 (FIG. 5), the end 20 becomes locked into position on fixture 42 in connection with the vertical attraction of magnet 76. The open bottom of the fixture 42 permits removal of the wire connection downward after the bale ends are ultimately joined.

Figure 1:
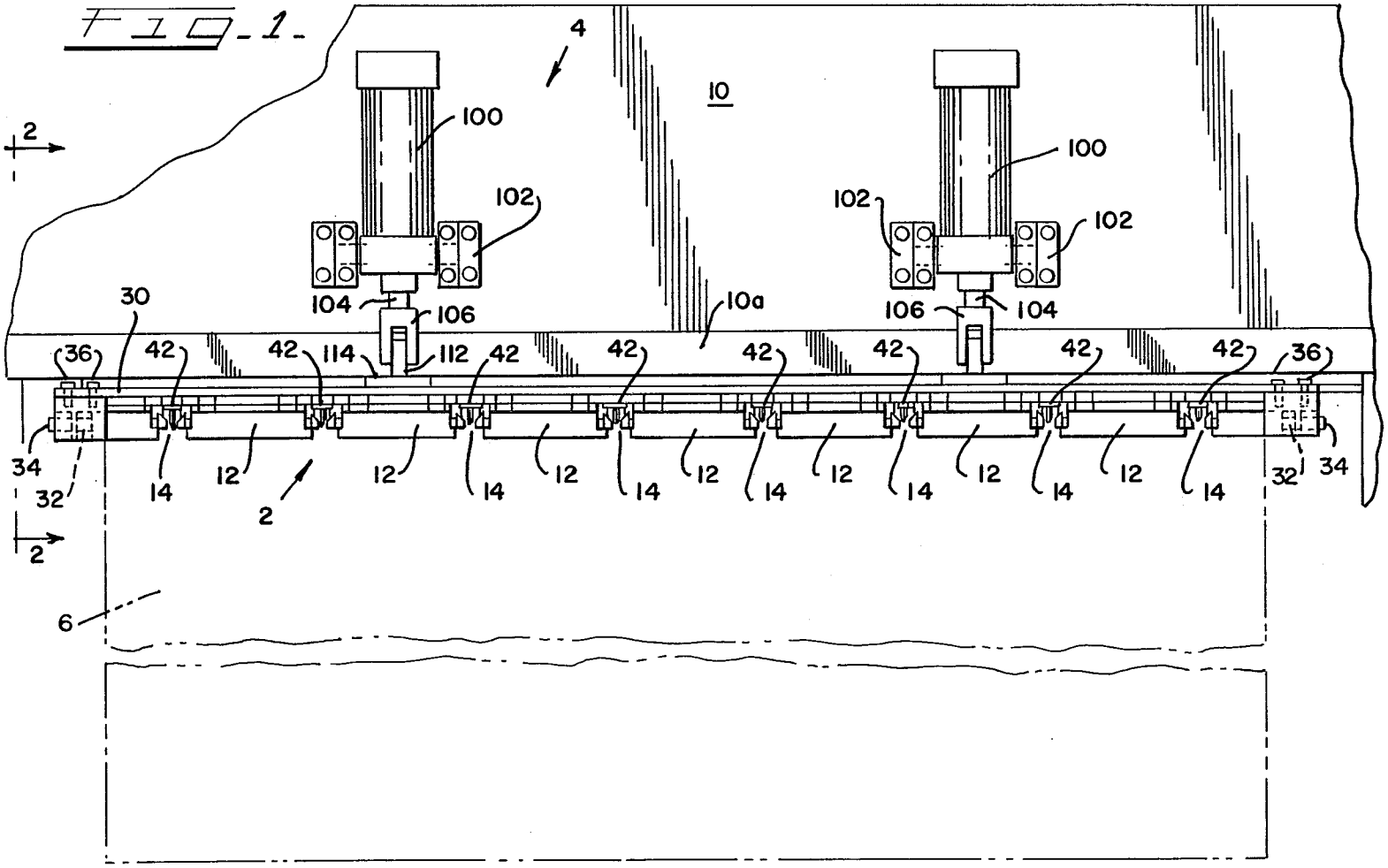
FIG. 1 is a front elevational view of the prefeed and bender assembly for wire bale ties mounted adjacent to a conventional bale press.
Figure 2:
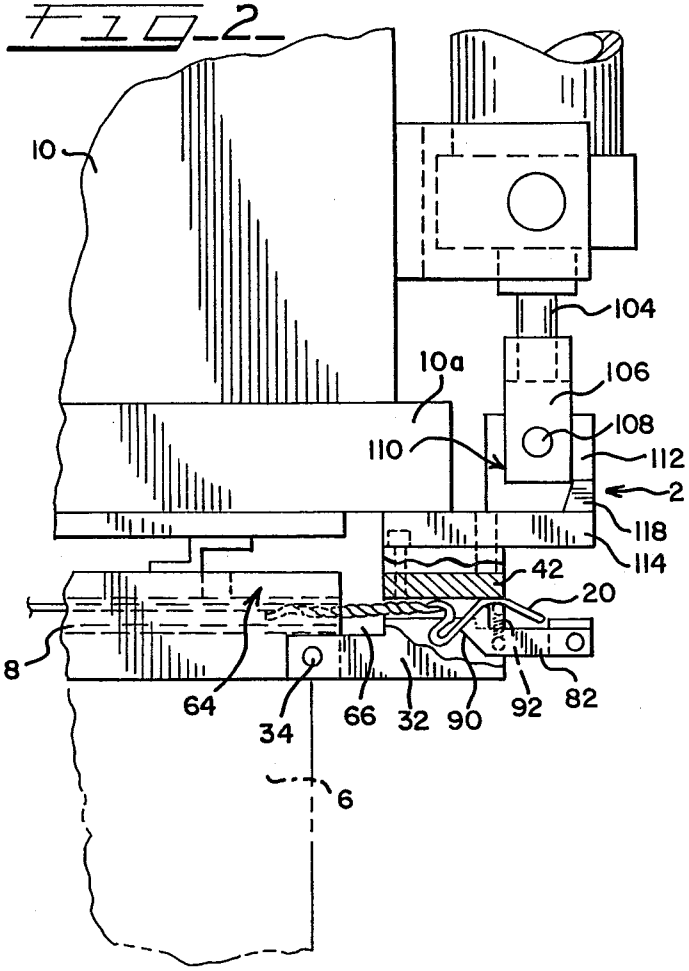
FIG. 2 is a side elevational view, with parts cut away, taken along line 2—2 of FIG. 1 with assembly in position after receipt of a preformed end of a wire tie.

As seen in FIGS. 1, 2 and 3, a pair of pneumatic cylinders 100 or other suitable power means are mounted above the fixtures 42 on the upper beam 10 of press 4 by means of conventional brackets and attachment members 102. The extensible ends 104 of the pneumatic cylinders 100 include a clevis 106 and pivot pin 108. As best seen in FIGS. 2 and 3, a cylinder pivot bracket 110 has a upper plate 112 that is rotatably mounted on the pivot pin 108. The bracket 110 further includes a lower plate 114 that is affixed in a normal relationship to upper plate 112 and extends into contact with a portion of elongated pivot bar 30. The lower plate 114 is in turn affixed to pivot bar 30 by means of one or more threaded members 116. A stop 118 having a beveled surface 120 is attached to lower plate 114 adjacent at least one side of plate 112. As seen in FIG. 3, the stop 118 contacts the clevis 106 during downward extension of extensible end 102 of each pneumatic cylinder 100 to limit the extent of rotation of the pivot bar 30 and fixtures 42.

In operation, the bale 6 is compressed against the upper platen 8 in a conventional manner in existing bale presses. After compression, the preformed ends 20 of each of the eight bale wires are manually fed through a respective one of bale tracks 16 situated in channels 14 in the upper platen 8. The magnets 64 at the ends of tracks 16 attract the leading ends 20 as they are fed across the gap to the eight fixtures 42 aligned therewith. The magnet 76 of each fixture 42 then attracts the leading end 20 of the wire upwardly as it moves through the entrance portion 74. The looped end 20 of the bale wire then rotates the resiliently mounted pivot arms 82 upon contact with the beveled edge 90 and passes into contact with end blocks 80. The pivot arms 82 return to their starting position and capture the end portion 20 in the fixture 42. The feeding procedure is repeated until the desired number of bale wires, such as eight as shown, are fed through upper platen 8.

In the captured position of the wire ends, the pneumatic cylinders 100 are then activated and simultaneously rotate the fixture 42 downward to bend the wires as shown in FIG. 3. The other preformed ends 22 of the bale wires are fed through the bottom platen (not shown) of the bale press. After being fed the opposite preformed ends 22) of the bale wire can easily be raised to the rotated fixtures 42 and joined to preformed ends 20 (FIG. 3). The open bottom of the fixtures 42 permits the bale connection to pulled out without damage or movement of the parts. After joining all ends of the eight or other desired number of connections, the operator returns the pneumatic cylinders 100 to the starting position to apply bale wires to next bale. In some known presses, front and rear doors (not shown) are swung open before rotation of the fixtures 42 and feeding of the ends 22 through the lower platen.

What is claimed is:

1. A pre-feed and bender assembly for applying bale wires having preformed ends to bales of material comprising fixture means being arranged to receive one preformed end of a bale wire being fed in a generally horizontal direction, said fixture means having retention means for retaining the preformed end of the bale wire being fed, mounting means being pivotally adjacent the bale and carrying said fixture means in a first position for receiving the preformed end of the bale wire being horizontally fed, and means for moving said mounting means and cause pivotal movement of said fixture means from said first position to a second position for bending the bale wire having a preformed end retained by said fixture means downward for joining with the preformed end of the opposite end of the bale wire.

2. The assembly according to claim 1 wherein said fixture means includes a plurality of fixtures arranged to receive a respectable preformed end of a plurality of bale wires being applied to the bale, each of said fixtures being capable of said pivotal movement.

3. The assembly according to claim 2, wherein said mounting means includes an elongated bar, said fixtures being affixed to said bar at a plurality of spaced positions.

4. The assembly according to claim 2 further including means to change the location of said fixed positions of said fixtures on said bar.

5. The assembly according to claim 4 wherein said means to change the location of said the location of said fixed positions includes a plurality of slots, said mounting means including attachment means for affixing said fixtures to a respective one of said slots, and said attachment means being selectively releasable for changing the fixed position of said fixtures in said slots.

6. The assembly according to claim 2 wherein said means to move said fixture means includes a pneumatic power means coupled to said mounting means, said pneumatic power means acting to cause said pivot movement of said fixtures on a simultaneous basis.

7. The assembly according to claim 1 further comprising track means arranged to be mounted on the upper platen of a bale press having a compacted bale to which bale wires are being applied, said track means permitting said bale wire having a preformed end to move horizontally across the upper platen prior to insertion into said fixture means.

8. A pre-feed and bender assembly for applying bale wires having preformed ends to bales of material comprising fixture means being arranged to receive one preformed end of a bale wire, said fixture means having retention means for retaining the preformed end of the bale wire, mounting means being pivotally mounted adjacent the bale and carrying said fixture means in a first position, means for moving said mounting means and cause pivotal movement of said fixture means from said first position to a second position for bending the bale wire having a preformed end retained by said fixture means, said fixture means includes access means for permitting the opposite preformed end of the bale wire to be inserted into said fixture means in said second position and joined in contact with the retained preformed end, and said access means further allowing removal of the joined preformed ends of the bale wire from said fixture means.

9. The assembly according the claim 8 wherein said access means forms an opening through said fixture means.

10. The assembly according to claim 9 wherein said fixture includes a top member and a pair of side walls connected to said top member and extending downward therefrom in said first position, and said side walls forming an open bottom for creating said opening.

11. The assembly according to claim 10 wherein said fixture means further includes locking means mounted between side walls, said locking means permitting insertion of the preformed end of a bale wire in a first direction in to said fixture, said locking means preventing withdrawal of the preformed end in the opposite direction to said first direction upon reaching a locking position in said fixture means.

12. A pre-feed and bender assembly for applying bale wires having preformed ends to bales of material comprising fixture means being arranged to receive one preformed end of a bale wire, said fixture means having retention means for retaining the preformed end of the bale wire, mounting means being pivotally mounted adjacent the bale and carrying said fixture means in a first position, means for moving said mounting means and cause pivotal movement of said fixture means from said first position to a second position for bending the bale wire having a preformed end retained by said fixture means, said fixture means includes access means for permitting the retained preformed end to be joined with the opposite preformed end of the bale wire in said second position, said access means further allowing removal of the joined preformed ends of the bale wire from fixture means, said access means forms an opening through said fixture means, said fixture includes a top member and a pair of side walls connected to said top member and extending downward therefrom in said first position, said side walls forming an open bottom for creating said opening, and said fixture means further includes locking means mounted between side walls said locking means permitting insertion of the preformed end of a bale wire in a first direction into said fixture, said locking means preventing withdrawal of the preformed end in the opposite direction to said first direction upon reaching a locking position in said fixture means.

13. The assembly according to claim 12 wherein said fixture means further includes retention means for retaining the bale wire in a horizontal position during movement in said first direction and in said locking position.

14. The apparatus according to claim 13 wherein said retention means includes a magnet mounted on said top member, said magnet permitting manual removal of the joined preformed ends of the bale wire through said opening.

15. The apparatus according to claim 12 wherein said locking means includes contacting means being arranged to contact the leading edge of the preformed end during said insertion in said first direction, said member being resiliently mounted on said fixture means to be deflected away to a deflected position and permit insertion of the preformed end to said locking position upon said contact, and said contacting means being moved back to said original position in said locking position of the preformed end to lock the preformed end in said opposite direction.

16. The assembly according to claim 15 wherein said contacting means includes a beveled surface for contacting the leading edge of the preformed end and causing said contacting means to be moved to said deflected position.

17. The assembly according the claim 16 wherein said contacting means includes at least one pivot arm having said beveled surface, said at least one pivot arm being pivotally mounted on one of said side walls, and spring means disposed between said pivot arm and said at least one of said side walls to create a resilient mounting.

18. A pre-feed and bender assembly for applying bale wire having preformed ends to bales of material comprising fixture means being arranged to receive one preformed end of a bale wire, said fixture means having retention means for retaining the preformed end of the bale wire, mounting means being pivotally mounted adjacent the bale and carrying said fixture means in a first position, means for moving said mounting means and cause pivotal movement of said fixture means from said first position to a second position for bending the bale wire having a preformed end retained by said fixture means, track means arranged to be mounted on the upper platen of a bale press having a compacted bale to which bale wires are being applied, said track means permitting said bale wire having a preformed end to move horizontally across the upper platen prior to insertion into said fixture means, and said fixture means is spaced in horizontal alignment in said first position with an end of said track means by a separated distance, said track means including guide means to maintain horizontal movement of the preformed end during movement across said separated distance.

19. The assembly according to claim 18 wherein said guide means includes a magnet mounted above the feed bale wire for vertically attracting the wire.

* * * * *